US007413028B2

(12) United States Patent
Comarmond

(10) Patent No.: US 7,413,028 B2
(45) Date of Patent: Aug. 19, 2008

(54) RAMMING DEVICE TO BE ASSIGNED TO A ROCK BREAKER

(75) Inventor: Jean-Sylvain Comarmond, Vourles (FR)

(73) Assignee: Montabert, Saint Priest (FR)

( * ) Notice: Subject to any disclaimer, the term of this patent is extended or adjusted under 35 U.S.C. 154(b) by 0 days.

(21) Appl. No.: 11/794,359

(22) PCT Filed: Feb. 6, 2006

(86) PCT No.: PCT/FR2006/000266

§ 371 (c)(1),
(2), (4) Date: Sep. 7, 2007

(87) PCT Pub. No.: WO2006/084980

PCT Pub. Date: Aug. 17, 2006

(65) Prior Publication Data

US 2007/0295520 A1 Dec. 27, 2007

(30) Foreign Application Priority Data

Feb. 10, 2005 (FR) ..... 05 01345

(51) Int. Cl.
*E02D 3/00* (2006.01)
*B25D 9/04* (2006.01)

(52) U.S. Cl. ..... 173/132; 173/29; 173/90; 279/19.5; 279/97; 404/133.1; 404/133.05

(58) Field of Classification Search ..... 173/29, 173/132, 113, 117, 118, 90, 171, 206; 404/133.1, 404/133.05; 279/97, 19.3, 19.5, 76, 85, 19.6; 408/239 R See application file for complete search history.

(56) References Cited

U.S. PATENT DOCUMENTS

| | | | | |
|---|---|---|---|---|
| 1,481,641 | A | 1/1924 | Jimerson | |
| 3,277,801 | A * | 10/1966 | Horvath et al. | 404/133.1 |
| 3,630,127 | A * | 12/1971 | Yamato | 404/133.1 |
| 3,635,133 | A * | 1/1972 | Stougaard | 404/133.2 |
| 3,815,705 | A * | 6/1974 | Bennett | 181/230 |
| 4,186,197 | A * | 1/1980 | Tetsuo | 404/133.1 |
| 5,102,200 | A * | 4/1992 | Woody | 299/37.5 |
| 5,340,233 | A * | 8/1994 | Motl | 404/133.05 |
| 5,388,842 | A | 2/1995 | Piras et al. | |
| 5,419,404 | A * | 5/1995 | Niemi et al. | 173/171 |
| 5,878,823 | A * | 3/1999 | Henriksson | 173/132 |
| 6,302,622 | B1 * | 10/2001 | Nagasawa | 404/133.1 |
| 6,328,116 | B1 * | 12/2001 | Hurskainen et al. | 173/128 |
| 6,698,531 | B2 * | 3/2004 | Kurten | 173/113 |
| 7,364,168 | B2 * | 4/2008 | Comarmond | 279/19.3 |

FOREIGN PATENT DOCUMENTS

JP A 11-209916 8/1999

* cited by examiner

*Primary Examiner*—Scott A. Smith
(74) *Attorney, Agent, or Firm*—Oliff & Berridge, PLC

(57) ABSTRACT

The ramming device comprises a ramming element to be assigned to the end of a rock breaker. The inventive device receives the shocks generated by the rock breaker and transmits them to fragments to be compacted. The ramming device also has a frame comprising: positioning structure for positioning relative to the rock-breaker so that the axis of the frame is coincident with the axis of the rock breaker; joining structure that enable the temporary and removable fixing of the frame to the end of the rock breaker; axially translational guiding structure for guiding the ramming element relative to the frame; structure for blocking the rotation of the ramming element about the axis of the frame, and; structure for limiting the amplitude of this translation.

14 Claims, 5 Drawing Sheets

RAMMING DEVICE TO BE ASSIGNED TO A ROCK BREAKER

The present invention relates to a compactor apparatus designed to be associated with a jackhammer mounted on the arm of a construction machine such as a mechanical shovel.

BACKGROUND OF THE INVENTION

Jackhammers, for example hydraulic jackhammers, are used to break up hard ground coverings or layers and to shatter blocks of rock or concrete during groundwork or demolition operations.

The operations of digging and then backfilling trenches usually require, in addition to a jackhammer, other equipment for clearing or compacting the fragments obtained.

Specific compacting machines may be used, such as a plate vibrator or a vibratory rammer, but they are costly and bulky on the worksite. That is why more flexible solutions have been envisaged, consisting in mounting on the jackhammer a compacting member whose upper portion forms an arm designed to allow attachment to the jackhammer and whose lower portion has the shape of a compacting plate.

DESCRIPTION OF THE PRIOR ART

In a first known embodiment, the arm and the plate of the compacting member are formed in a single piece. The contact between the plate and the fragments to be compacted generates torsional and bending forces, particularly because the plate rests on an uneven surface, and may rest, in the vicinity of its edges, on protruding fragments. These forces are transmitted to the arm, which leads to the appearance of considerable stresses in the junction zone between the plate and the arm and may lead to the breakage of the compacting member at this junction zone. In addition, considerable forces are applied to the jackhammer which adversely affects the longevity of the assembly.

Furthermore, the compacting member is mounted on the jackhammer instead of the tool. Therefore, the tool must first be removed, which involves awkward manipulations and a waste of time, the construction machine then being immobilized.

In a second known embodiment, the compacting member is formed from two separate parts, the arm and the plate, attached to one another by a conical assembly. The forces due to compacting are transmitted to the arm via the conical zone of connection between the two parts. There again, the result of this is a weakening of this zone, accentuated by the fact that the compacting member is formed of two assembled parts. In the fairly long term, the compacting member risks being broken. In addition, the disadvantage associated with the necessary removal of the tool is not resolved by this second known embodiment.

The invention aims to remedy the aforementioned disadvantages.

SUMMARY OF THE INVENTION

A first objective of the invention is to provide a compactor apparatus that has a better mechanical strength and hence an increased service life, and that limits the magnitude of the forces applied to the jackhammer.

Another objective of the invention is to provide such a compactor apparatus that can be mounted directly on the tool, without requiring the prior removal of the latter.

Accordingly, the invention relates to a compactor apparatus comprising a compacting member designed to be associated with the end of a jackhammer mounted on the arm of a construction machine and being able to be fitted with a tool, the compactor apparatus being designed to receive the impacts generated by the jackhammer and to transmit them to the fragments to be compacted.

The compactor apparatus more particularly characterized in that it also comprises a frame having an axis and comprising:

- positioning means allowing the correct positioning of the frame relative to the jackhammer, so that the axis of the frame is substantially indistinguishable from the axis of the jackhammer;
- fixed attachment means allowing the temporary and removable attachment of the frame to the end of the jackhammer;
- means for guidance in substantially axial translation of the compacting member relative to the frame, means for preventing the rotation of the compacting member about the axis of the frame, and means for limiting the amplitude of said translation.

Therefore, the frame acts as a reinforcement by absorbing the forces exerted on the compacting member during compacting, whether they be torsional or bending forces. As a result of this, on the one hand, the compacting member sustains less stresses, which increases its service life, in particular via the preservation of the weakest zones capable of being broken first. Furthermore, through the presence of the frame, the forces exerted on the jackhammer are also reduced.

According to one possible embodiment, the compacting member comprises a compacting plate from which protrudes substantially perpendicularly a central arm, and the guidance means made in the frame comprise a substantially axial tubular body open at its two ends in which the arm is capable of being engaged through a first end. The interaction between the arm of the compacting member and the body of the frame therefore ensures, at least in part, the guidance and the absorption of the forces due to compacting.

The tubular body has for example a noncircular, internal cross section of a shape matching the external cross section of the arm, in order to allow the transmission of the torsion forces. For example, the arm could be cylindrical of revolution but provided with a flat.

The means for limiting the amplitude of the translation movement of the compacting member comprise for example a chain or a cable whose first end is attached to the frame and whose second end is attached to the compacting member, or a keying system.

The compacting member may comprise a wall whose shape matches that of a portion of a tool fitted to the jackhammer, said wall forming an abutment surface of the tool for the transmission to the compacting member of the impacts generated by the jackhammer, via the tool.

According to a first embodiment, the arm of the compacting member comprises an axial orifice in which the tool is designed to be at least partially engaged. The tool then fulfills a role of a post, serving as a means of additional positioning, reinforcement and support. The stability of the apparatus is thereby increased. In addition, in this embodiment, it is not necessary to remove the tool from the end of the jackhammer to install the compactor apparatus.

The abutment surface may then be formed by a wall recessed like a funnel forming the insertion end of the orifice, said wall being designed to interact with a collar of the tool.

As a variant, the abutment surface is formed by the bottom of the orifice, designed to interact with the free end of the tool.

According to a second embodiment, the abutment surface is formed by the free end of the arm of the compacting member, said free end being substantially transverse and flat and designed to interact with the substantially transverse and flat free end of the tool.

Finally, according to a third embodiment, the abutment surface is formed by the free end of the arm of the compacting member, said free end having substantially the shape of a spherical skullcap and being designed to interact with the free end of the tool in the shape of a matching spherical skullcap.

In this case, the arm may have an axially domed shape, so that the compacting member can rotate relative to the frame about at least one transverse axis, with a limited amplitude. Therefore, the arm can "oscillate" inside the frame, and the compacting plate can orient itself automatically in a trench if it is guided by the edges of this trench.

The compactor apparatus may also comprise an intermediate wearing part whose mechanical resistance to the impacts is greater than that of the compacting member, said intermediate part being designed to receive the impacts generated by the jackhammer and transmit them downstream to the compacting member. The intermediate part may be easily replaced, and the service life of the compacting member is thereby increased.

According to one possible embodiment, the compacting plate has an elongated rectangular shape whose small opposite sides are raised in the direction of the arm.

The invention also relates to a construction machine comprising a jackhammer fitted with a compactor apparatus as previously described.

To be clearly understood, the invention is again described below with reference to the appended figures representing, as nonlimiting examples, several possible embodiments of the compactor apparatus.

DESCRIPTION OF THE PREFERRED EMBODIMENTS

Figure 1:
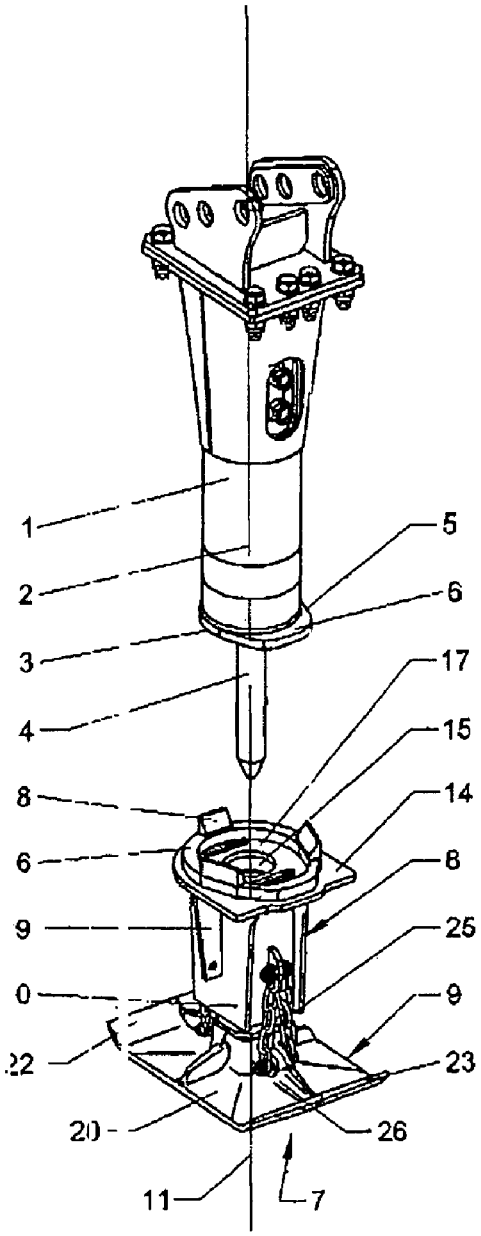
FIG. 1 is a view in perspective of a compactor apparatus according to the invention and of a jackhammer provided with a tool, seen in the removed position.
Figure 2:
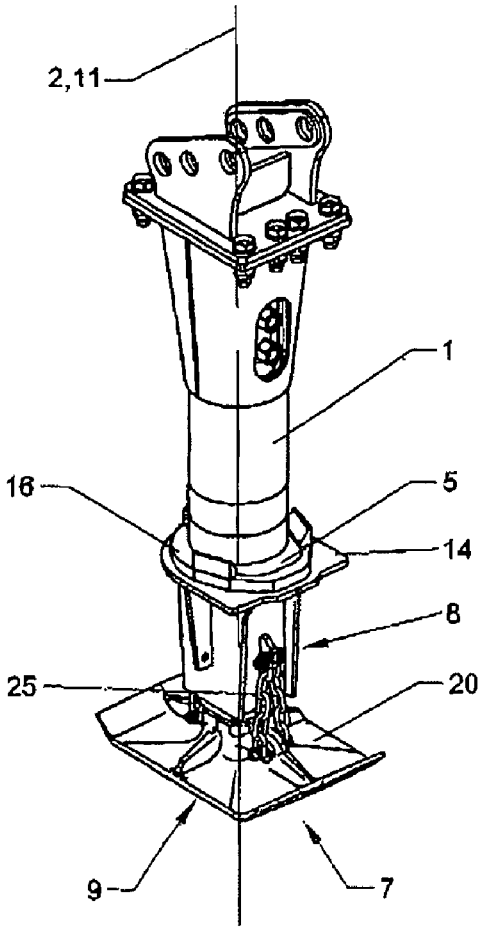
FIG. 2 is a view similar to FIG. 1, the compactor apparatus being assembled to the jackhammer.
Figure 3:
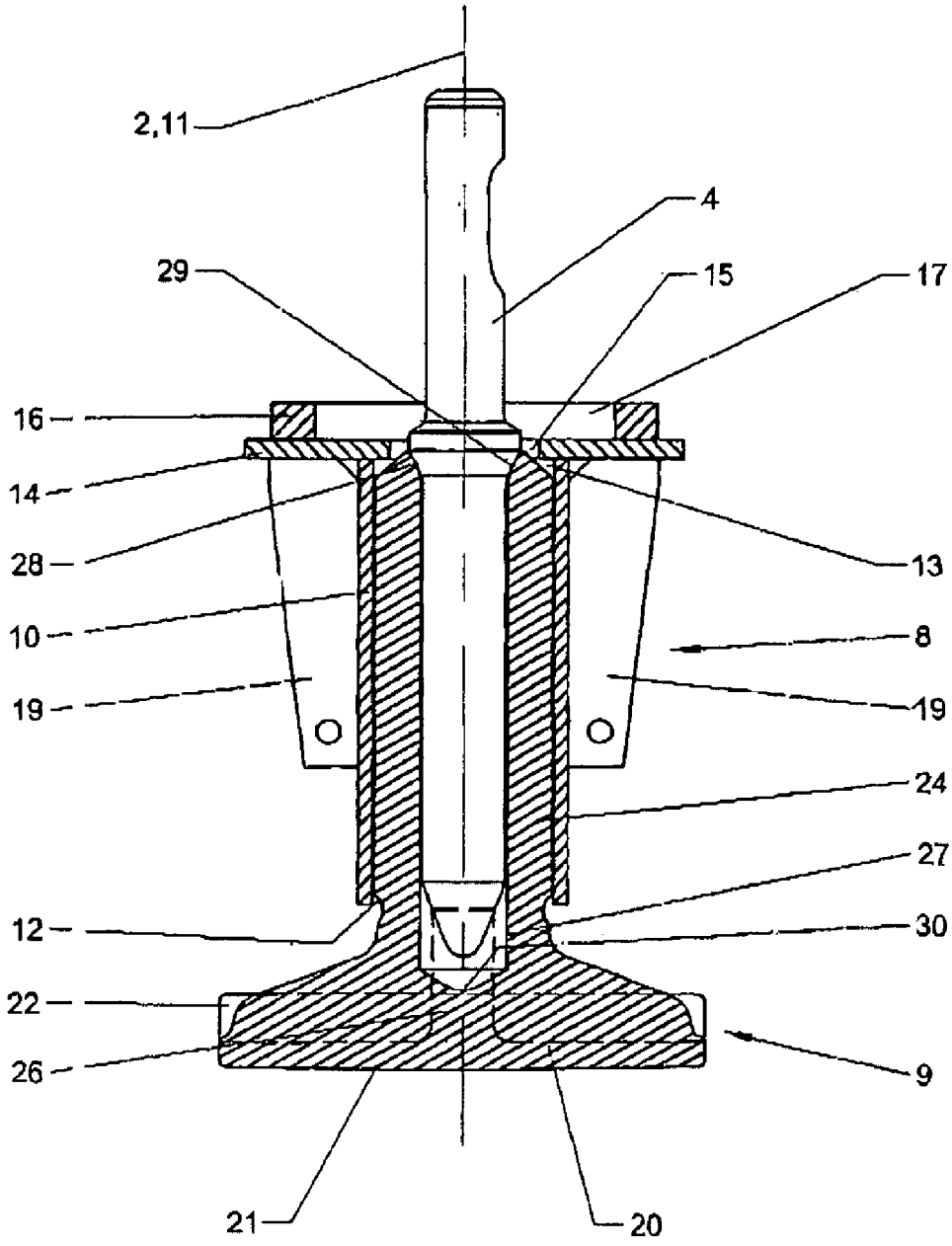
FIG. 3 is a partial view in longitudinal section of a first embodiment of the compactor apparatus and of the jackhammer when they are assembled.

A hydraulic jackhammer, partially represented in FIGS. 1 and 2, comprises a body 1 of substantially circular cross section with an axis 2, and has an end 3 to which a tool 4 is connected, such as a pickaxe or a chisel. In a known manner, the jackhammer generates impacts, axially, that are transmitted to the tool 4. The end 3 of the body 1 is also provided with a collar 5 having an ovoid cross section and therefore having a portion 6 protruding from the body 1.

A compactor apparatus 7 is designed to be attached to the end 3 of the jackhammer when it is desired to compact the fragments obtained by action of the jackhammer and its tool 4. The compactor apparatus 7 comprises on the one hand a frame 8 and on the other hand a compacting member 9.

The frame 8 comprises a hollow tubular body 10, with an axis 11, open at its first axial end 12 and at its second axial end 13, and with a noncircular internal cross section. In the embodiment shown, the body 10 comprises four perpendicular side walls and therefore has a rectangular cross section.

A base 14, furnished with a central opening 15 of greater cross section than the maximum diameter of the tool 4, is attached transversely to the second end 13 of the body 10, so that the opening 15 is substantially coaxial with the body 10.

For simplification purposes, the rest of the description will be made in the position in which the body 10 of the frame 8 is vertical, the base 14 being horizontal and above the body 10, this position corresponding substantially to the position of use.

A substantially annular border 16 protrudes vertically upward from the base 14, around and at a distance from the opening 15, and defines a housing 17 whose axial and transverse shape and dimensions are adapted to those of the collar 5. Positioning fingers 18 are made on the border 16, at regular intervals, and each has an inclined surface converging toward the opening 15.

In this manner, the frame 8 may be fixedly attached to the end 2 of the body 1 of the jackhammer, in a temporary and removable manner. For this, the frame 8 is moved closer to the body 1, whether or not furnished with the tool 3, the collar 5 is guided by the fingers 18 then engaged in the housing 17 and pressed against the bottom of the latter, the matching of the shapes ensuring the correct positioning of the frame 8. Once the collar 5 is in place, its upper face is situated in the same plane as the upper face of the border 16. The assembly is then locked in this position by any appropriate device, not shown, such as a latch, hooks made on the fingers 18, or a system of vertical lugs placed facing one another and furnished with eye holes in which a retention bar can be engaged locking the collar in position in the housing 17.

Finally, a lug 19 protruding perpendicularly from a side wall of the body 10 outward, and attached to the lower face of the base 16 reinforces the structure of the frame 8. Another identical lug 19 is placed symmetrically on the opposite lateral side of the body 10.

The compacting member 9 comprises on the one hand a substantially rectangular compacting plate 20 whose face forms a soleplate 21 designed to be pressed upon the fragments to be compacted. The plate 20 comprises two opposite end portions 22, 23 raised in the opposite direction from the soleplate 21.

The compacting member 9 also comprises a central arm 24 protruding perpendicularly to the plate 20 from the face opposite to the soleplate 21, the arm 24 and the plate 20 being made in a single piece. The arm 24 is designed to be inserted axially into the body 10 of the frame 8 and to interact with the inner face of the body 10. Accordingly, the shape and the dimensions of the arm 24 are adapted to those of the body 10. Here, the arm 10 has an external rectangular cross section matching the internal cross section of the body 10, so that the compactor apparatus 7 can slide along the axis 11 in the body 10 but be prevented from rotating about the axis 11.

The amplitude of the axial translation of the arm 24 in the body 10 is limited by chains 25 placed on the outside of the body 10. The first end of each of the chains is attached to the body 10, via a bolt interacting with a lug, and the second end of each of the chains is attached via a bolt to one of the reinforcing ribs 26 provided between the plate 20 and the arm 24. The length of each chain 25 is greater than the distance existing between the attachment points of its ends when the arm is engaged to the maximum in the body 10. However the length of each chain 25 is short enough to allow only a slight amplitude of axial translation of the arm 24, and particularly to prevent the arm 24 from disengaging from the body 10.

The operation of the compactor apparatus 7 mounted on the jackhammer is as follows: the impacts generated by the jackhammer (produced by the striker piston of the jackhammer on the upper face of the tool 4) are transmitted from the tool to the compacting member 9, and in particular to the plate 20, which makes it possible to compact the fragments situated beneath the soleplate 21.

Several embodiments of the compactor apparatus are now described with reference to FIGS. 3 to 6.

In a first embodiment (FIGS. 3 and 4), the arm 24 is slightly higher than the height of the body 10 and comprises a cylindrical axis orifice 27 of a slightly greater diameter than the external diameter of the tool 4. The orifice 27 has an upper end whose side wall 28 is recessed like a funnel.

The compactor apparatus 7 is installed on the jackhammer as follows. The compacting member 9 is first of all mounted in the frame 8, by engagement of the arm 24 in the body 10 via the first end 12, then attachment of the chains 25. The compacting member 7 thus constituted is then mounted on the jackhammer without the tool 4 being removed. The tool is engaged in the orifice 27, via the upper end of the latter, and the frame 8 is moved closer to the body 1 of the jackhammer until the collar 5 is placed in the housing 17 as previously described, the axes 2 and 11 then being substantially indistinguishable. At the end of mounting, that is to say in the position of use, the recessed wall 28 forms an abutment surface designed to interact with a collar 29 of the tool 4 for the transmission of the impacts generated by the jackhammer, if the free end of the tool 4 is not in contact with the bottom 30 of the orifice 27.

Figure 4:
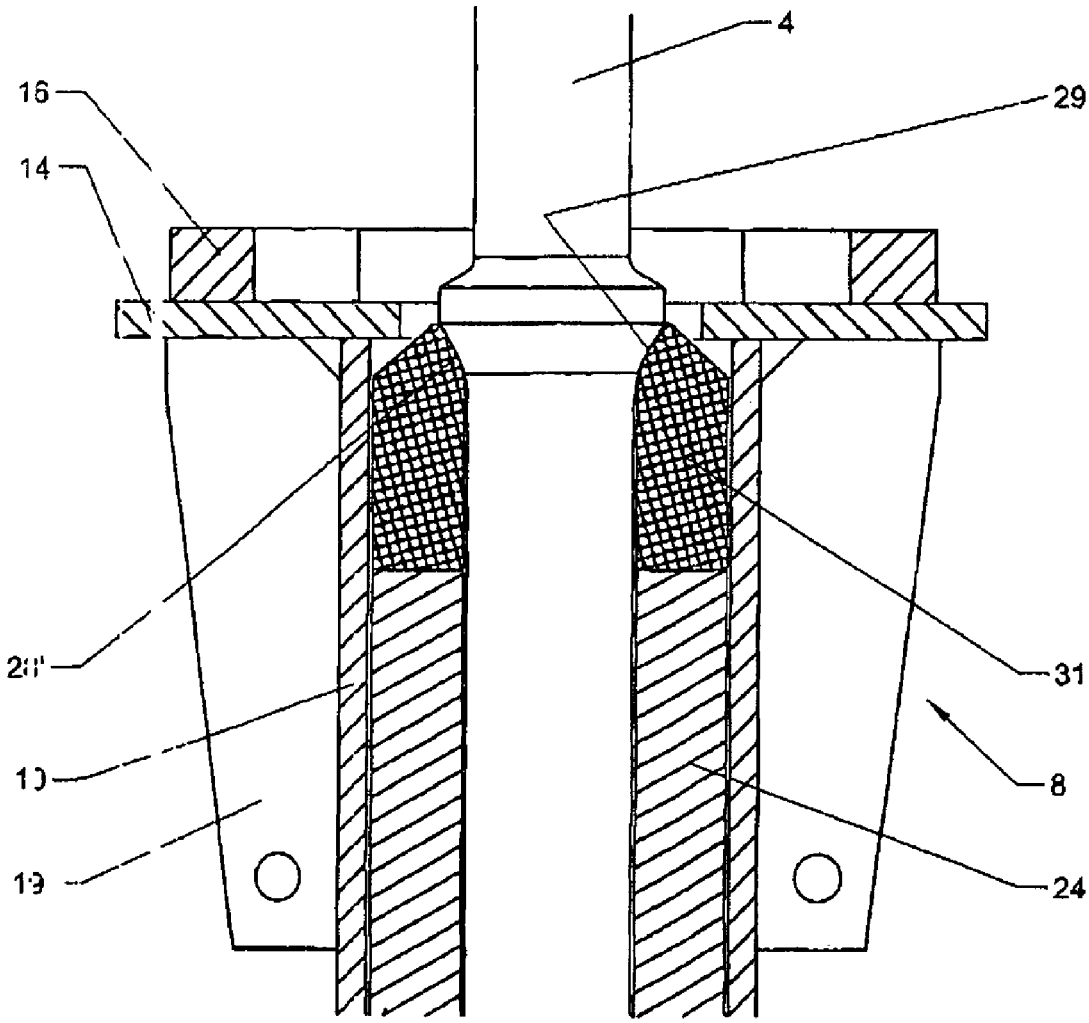
FIG. 4 is a partial view similar to FIG. 3, showing a variant of the first embodiment.
Figure 5:
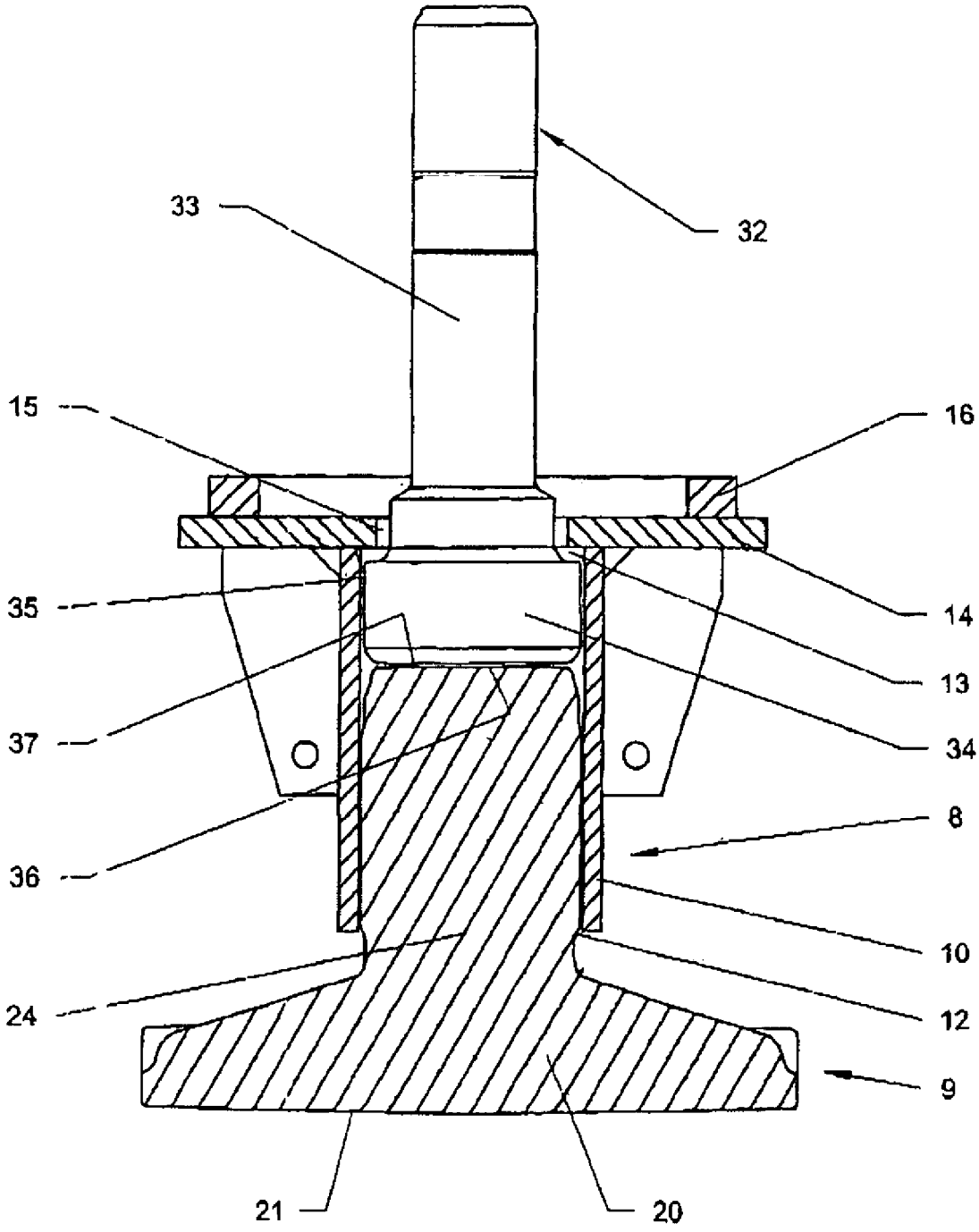
FIG. 5 is a view similar to FIG. 3, illustrating a second embodiment.
Figure 6:
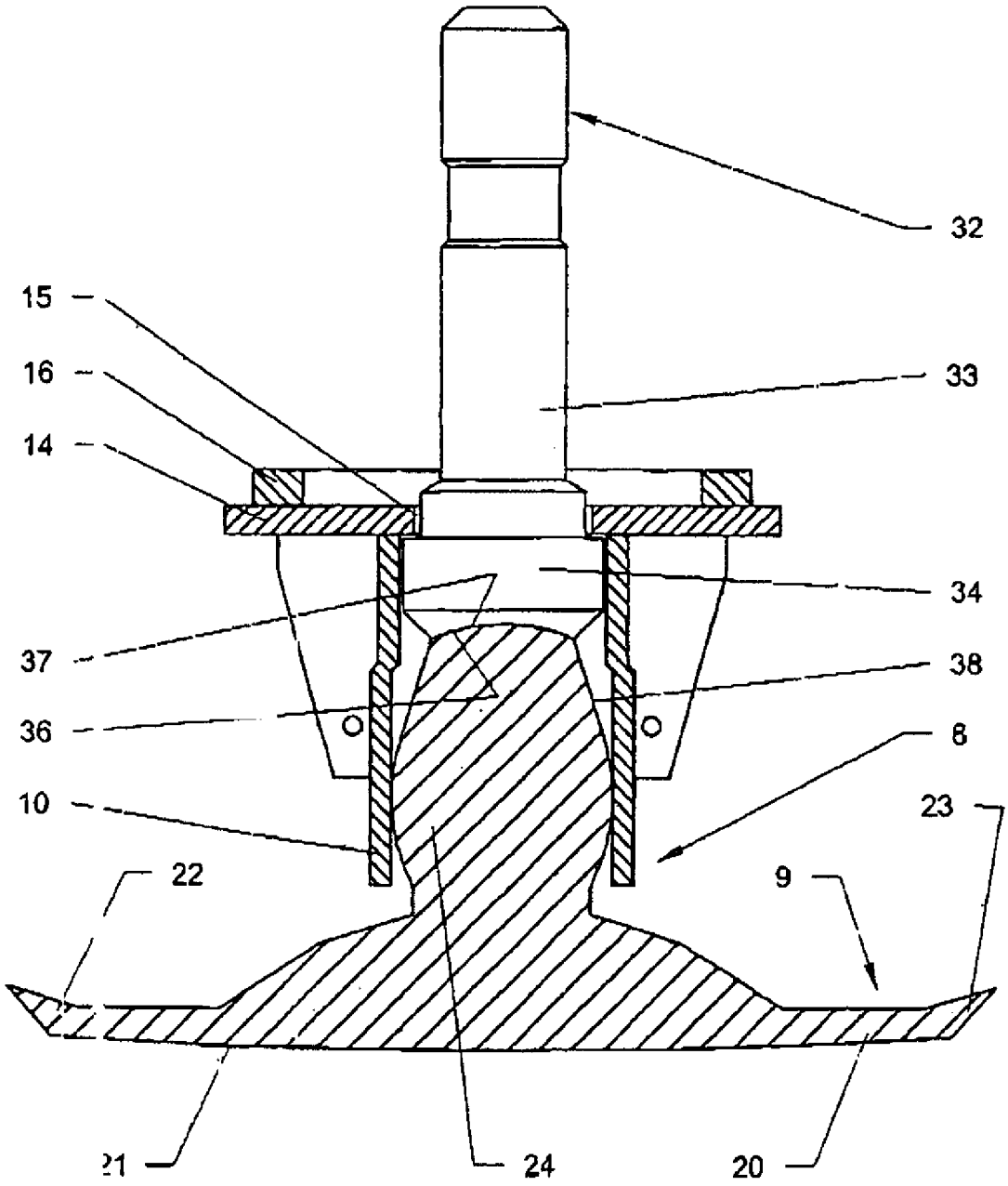
FIG. 6 is a view similar to FIG. 3, illustrating a third embodiment.

The impacts generated by the jackhammer cause considerable wear of the upper end of the arm 24 in contact with the tool 4. That is why, as shown in FIG. 4, provision may be made to insert between the upper end of the arm 24 and the collar 29 of the tool 4 an intermediate wearing part 31, having a recessed wall 28' identical to the recessed wall 28 of the arm 24 of FIG. 3. In this case, the arm 24 may be made of forged steel, while the intermediate part 31 is made of tougher hardened steel. Attachment between these two parts is not necessary, because they are automatically in contact when the jackhammer generates impacts.

In a second embodiment (FIG. 5), the arm 24 is solid and of lesser height than the height of the body 10, and the compactor apparatus 7 also comprises a tool 32 designed to be mounted on the jackhammer instead of the tool 4 specific to the jackhammer. The tool 32 comprises a cylindrical upper portion 33 designed to be attached to the body 1 of the jackhammer and a cylindrical lower portion 34 having a greater diameter, greater than the diameter of the opening 15 of the base 14 but less than the internal dimensions of the body 10.

To install this compactor apparatus 7, it is necessary first to remove the tool 4. The compactor apparatus 7 is put together as follows: first of all, the tool 32 is engaged axially in the body 10 via the first end 12, until the upper portion protrudes outside of the frame 8, then the arm 24 is in turn engaged in the body 10 and held in position by the attachment of the chains 25. The assembly is then mounted on the jackhammer, the upper portion 33 of the tool 32 and the frame 8 both being attached to the body 1. It should be noted that the lower portion 34 of the tool 32 butts against the lower face 35 of the base 14, in the vicinity of the opening 15, the tool 32 therefore not being able to be removed from the body 10 via the second end 13. This configuration is worthwhile since it makes it easier to install the compactor apparatus 7, the tool 32 remaining linked to the compactor apparatus 7 during its mounting and its removal.

An arrangement in which the tool 32 does not butt against the lower face 35 of the base 14 can also be envisaged, although it is less practical since it requires other connection means.

The free end 36 of the arm 24, transverse and flat, forms a surface of abutment with the free end 37 of the lower portion 34 of the tool 32, also transverse and flat, allowing the transmission of the impacts for compacting. This abutment surface being situated inside the body 10, there is very good guidance and very good absorbance of the forces during compacting. An intermediate wearing part may also be provided.

In a third embodiment (FIG. 6), the compactor apparatus 7 again comprises a tool 32 designed to be mounted on the jackhammer instead of the tool 4 specific to the jackhammer. The tool 32 has a shape similar to that shown in FIG. 5, except for the free end 37 of the lower portion 34, which, in this third embodiment, is in the shape of a concave spherical skullcap.

The arm 24 is solid and of lesser height than the height of the body 10. It has an axially domed side wall 38 and a free end 36 having the shape of a convex spherical skullcap matching the shape of the free end 37 of the lower portion 34 of the tool 32, and forming an abutment surface for the transmission of the impacts for compacting with, where necessary, the insertion of a wearing part. The body 10 may comprise a lower portion of enlarged diameter to receive the domed arm 24. Finally, the compacting plate 20 is narrow and elongated, like a ski.

Mounting is carried out in a similar manner to what has been described in relation to FIG. 2. Once mounted, the compacting member 9 may oscillate slightly relative to the frame 8 due to the domed shape of the arm 24 and of the skullcap shapes of the free ends 36, 37. Thanks to this ball-and-socket movement of limited amplitude, the plate 20 may be guided by the edges of a trench during the movement of the construction machine fitted with the jackhammer, and may, on its own, be oriented appropriately in this trench. This structure is particularly useful in the case of narrow trenches (of a width of the order of 15 cm for example), typically used for laying optical fibers. Specifically, since no existing compactor apparatus can enter the trench, it is routine to find subsidence of the surface of such trenches, unless costly filling materials requiring no compacting are used.

It goes without saying that the invention is not limited to the embodiment described above as an example but that, on the contrary, it embraces all the variant embodiments thereof.

The invention claimed is:

1. A compactor apparatus comprising a compacting member designed to be associated with the end of a jackhammer mounted on the arm of a construction machine and being able to be fitted with a tool, the compactor apparatus being designed to receive the impacts generated by the jackhammer and to transmit them to the fragments to be compacted, wherein the compactor apparatus also comprises a frame having an axis and comprising:

positioning means allowing the correct positioning of the frame relative to the jackhammer, so that the axis of the frame is substantially indistinguishable from the axis of the jackhammer, fixed attachment means allowing the temporary and removable attachment of the frame to the end of the jackhammer;

means for guidance in substantially axial translation of the compacting member relative to the frame, means for preventing the rotation of the compacting member about the axis of the frame, and means for limiting the amplitude of said translation.

2. The compactor apparatus as claimed in claim 1, wherein the compacting member comprises a compacting plate from which protrudes substantially perpendicularly a central arm, and in that the guidance means made in the frame comprise a substantially axial tubular body open at its two ends in which the arm is capable of being engaged through a first end.

3. The compactor apparatus as claimed in claim 2, wherein the tubular body has a noncircular, internal cross section of a shape matching the external cross section of the arm.

4. The compactor apparatus as claimed in claim 2, wherein the arm of the compacting member comprises an axial orifice in which the tool is designed to be at least partially engaged.

5. The compactor apparatus as claimed in claim 2, wherein the abutment surface is formed by the free end of the arm of the compacting member, said free end being substantially transverse and flat and designed to interact with the substantially transverse and flat free end of the tool.

6. The compactor apparatus as claimed in claim 2, wherein the abutment surface is formed by the free end of the arm of the compacting member, said free end having substantially the shape of a spherical skullcap and being designed to interact with the free end of the tool in the shape of a matching spherical skullcap.

7. The compactor apparatus as claimed in claim 6, wherein the arm has an axially domed shape, so that the compacting member can rotate relative to the frame about at least one transverse axis, with a limited amplitude.

8. The compactor apparatus as claimed in claim 2, wherein the compacting plate has an elongated rectangular shape whose small opposite sides are raised in the direction of the arm.

9. The compactor apparatus as claimed in claim 1, wherein the means for limiting the amplitude of the translation movement of the compacting member comprise a chain or a cable whose first end is attached to the frame and whose second end is attached to the compacting member, or a keying system.

10. The compactor apparatus as claimed in claim 1, wherein the compacting member comprises a wall whose shape matches that of a portion of a tool fitted to the jackhammer, said wall forming an abutment surface of the tool for the transmission to the compacting member of the impacts generated by the jackhammer, via the tool.

11. The compactor apparatus as claimed in claim 10, wherein the abutment surface is formed by a wall recessed like a funnel forming the insertion end of the orifice, said wall being designed to interact with a collar of the tool.

12. The compactor apparatus as claimed in claim 10, wherein the abutment surface is formed by the bottom of the orifice, designed to interact with the free end of the tool.

13. The compactor apparatus as claimed in claim 1, wherein it comprises an intermediate wearing part whose mechanical resistance to the impacts is greater than that of the compacting member, said intermediate part being designed to receive the impacts generated by the jackhammer and transmit them downstream to the compacting member.

14. Construction machine comprising a jackhammer fitted with a compactor apparatus as claimed in claim 1.

* * * * *